US007934825B2

(12) United States Patent
Lang

(10) Patent No.: US 7,934,825 B2
(45) Date of Patent: May 3, 2011

(54) EFFICIENT CROSS-STREAM PRINTING SYSTEM

(75) Inventor: Joseph H. Lang, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 1108 days.

(21) Appl. No.: 11/708,298

(22) Filed: Feb. 20, 2007

(65) Prior Publication Data

US 2008/0196606 A1 Aug. 21, 2008

(51) Int. Cl.
*B41J 2/01* (2006.01)
*G03G 15/00* (2006.01)

(52) U.S. Cl. ..... 347/104; 101/2

(58) Field of Classification Search ..... 347/101, 347/104, 139, 153, 262, 264
See application file for complete search history.

(56) References Cited

U.S. PATENT DOCUMENTS 4,579,446 A 4/1986 Fujino et al.
4,587,532 A 5/1986 Asano
4,836,119 A 6/1989 Siraco et al.
5,004,222 A 4/1991 Dobashi
5,008,713 A 4/1991 Ozawa et al.
5,080,340 A 1/1992 Hacknauer et al.
5,095,342 A 3/1992 Farrell et al.
5,159,395 A 10/1992 Farrell et al.
5,208,640 A 5/1993 Horie et al.
5,272,511 A 12/1993 Conrad et al.
5,326,093 A 7/1994 Sollitt
5,435,544 A 7/1995 Mandel
5,473,419 A 12/1995 Russel et al.
5,489,969 A 2/1996 Soler et al.
5,504,568 A 4/1996 Saraswat et al.
5,525,031 A 6/1996 Fox
5,557,367 A 9/1996 Yang et al.
5,568,246 A 10/1996 Keller et al.
5,570,172 A 10/1996 Acquaviva
5,596,416 A 1/1997 Barry et al.
5,629,762 A 5/1997 Mahoney et al.
(Continued)

OTHER PUBLICATIONS

Morgan, P.F., "Integration of Black Only and Color Printers", Xerox Disclosure Journal, vol. 16, No. 6, Nov./Dec. 1991, pp. 381-383.

(Continued)

*Primary Examiner* — Matthew Luu
*Assistant Examiner* — Kendrick X Liu
(74) *Attorney, Agent, or Firm* — Fay Sharpe LLP

(57) ABSTRACT

A printing system includes first and second marking engines which output marked print media to first and second angularly spaced print streams. The marking engines define, at least in part, first and second sides of a working area, whereby a user has access to the first and second marking engines via access members on the first and second sides of the working area. A merge module receives print media from the first and second print streams. The merge module includes at least one rotate and redirect path for merging print media from one of the first and second streams with print media from the other of the first and second streams to generate a merged print stream. At least one finisher receives the merged print stream from the merge module.

22 Claims, 7 Drawing Sheets

U.S. PATENT DOCUMENTS 5,710,968 A 1/1998 Clark et al.
5,778,377 A 7/1998 Marlin et al.
5,826,157 A * 10/1998 Wierszewski ..... 399/396
5,884,910 A 3/1999 Mandel
5,995,721 A 11/1999 Rourke et al.
6,059,284 A 5/2000 Wolf et al.
6,125,248 A 9/2000 Moser
6,241,242 B1 6/2001 Munro
6,297,886 B1 10/2001 Cornell
6,341,773 B1 1/2002 Aprato et al.
6,384,918 B1 5/2002 Hubble, III et al.
6,450,711 B1 9/2002 Conrow
6,476,376 B1 11/2002 Biegelsen et al.
6,476,923 B1 11/2002 Cornell
6,493,098 B1 12/2002 Cornell
6,537,910 B1 3/2003 Burke et al.
6,550,762 B2 4/2003 Stoll
6,554,276 B2 4/2003 Jackson et al.
6,577,925 B1 6/2003 Fromherz
6,607,320 B2 8/2003 Bobrow et al.
6,608,988 B2 8/2003 Conrow
6,612,566 B2 9/2003 Stoll
6,612,571 B2 9/2003 Rider
6,621,576 B2 9/2003 Tandon et al.
6,633,382 B2 10/2003 Hubble, III et al.
6,639,669 B2 10/2003 Hubble, III et al.
6,819,906 B1 11/2004 Herrmann et al.
6,925,283 B1 8/2005 Mandel et al.
6,959,165 B2 10/2005 Mandel et al.
6,973,286 B2 12/2005 Mandel et al.
7,024,152 B2 4/2006 Lofthus et al.
7,123,873 B2 10/2006 deJong et al.
7,162,172 B2 1/2007 Grace et al.
2002/0078012 A1 6/2002 Ryan et al.
2002/0103559 A1 8/2002 Gartstein
2003/0077095 A1 4/2003 Conrow
2004/0085561 A1 5/2004 Fromherz
2004/0085562 A1 5/2004 Fromherz
2004/0088207 A1 5/2004 Fromherz
2004/0150156 A1 8/2004 Fromherz et al.
2004/0150158 A1 8/2004 Biegelsen et al.
2004/0153983 A1 8/2004 McMillan
2004/0216002 A1 10/2004 Fromherz et al.
2004/0225391 A1 11/2004 Fromherz et al.
2004/0225394 A1 11/2004 Fromherz et al.
2004/0247365 A1 * 12/2004 Lofthus et al. ..... 400/582
2006/0033771 A1 * 2/2006 Lofthus ..... 347/40
2006/0066885 A1 3/2006 Anderson et al.
2006/0067756 A1 3/2006 Anderson et al.
2006/0067757 A1 3/2006 Anderson et al.
2006/0083534 A1 * 4/2006 Ogura ..... 399/88
2006/0114313 A1 6/2006 Moore
2006/0114497 A1 6/2006 Anderson et al.
2006/0115287 A1 6/2006 Roof
2006/0115288 A1 6/2006 Roof
2006/0132815 A1 6/2006 Lofthus et al.
2006/0176336 A1 8/2006 Moore et al.
2006/0197966 A1 9/2006 Viturro et al.
2006/0209101 A1 9/2006 Mizes
2006/0214359 A1 9/2006 Clark
2006/0214364 A1 9/2006 Clark et al.
2006/0215240 A1 9/2006 Mongeon
2006/0221159 A1 10/2006 Moore et al.
2006/0221362 A1 10/2006 Julien et al.
2006/0222378 A1 10/2006 Julien
2006/0222384 A1 10/2006 Moore et al.
2006/0222393 A1 10/2006 de Jong et al.
2006/0227350 A1 10/2006 Crawford et al.
2006/0230201 A1 10/2006 Fromherz et al.
2006/0230403 A1 10/2006 Crawford et al.
2006/0233569 A1 10/2006 Furst et al.
2006/0235547 A1 10/2006 Hindi et al.
2006/0238778 A1 10/2006 Mongeon et al.
2006/0244980 A1 11/2006 Grace
2006/0250636 A1 11/2006 Richards
2006/0268317 A1 11/2006 Lofthus et al.
2006/0268318 A1 11/2006 Lofthus et al.
2006/0269310 A1 11/2006 German et al.
2006/0274334 A1 12/2006 Mongeon
2006/0274337 A1 12/2006 Dalal et al.
2006/0280517 A1 12/2006 Roof et al.
2006/0285159 A1 12/2006 Frankel

OTHER PUBLICATIONS

Desmond Fretz, "Cluster Printing Solution Announced", Today at Xerox (TAX), No. 1129, Aug. 3, 2001.
U.S. Appl. No. 10/785,211, filed Feb. 24, 2004, Lofthus et al.
U.S. Appl. No. 10/881,619, filed Jun. 30, 2004, Bobrow.
U.S. Appl. No. 10/917,676, filed Aug. 13, 2004, Lofthus et al.
U.S. Appl. No. 10/924,458, filed Aug. 23, 2004, Lofthus et al.
U.S. Appl. No. 10/924,459, filed Aug. 23, 2004, Mandel et al.
U.S. Appl. No. 10/933,556, filed Sep. 3, 2004, Spencer et al.
U.S. Appl. No. 10/953,953, filed Sep. 29, 2004, Radulski et al.
U.S. Appl. No. 10/999,450, filed Nov. 30, 2004, Lofthus et al.
U.S. Appl. No. 11/000,168, filed Nov. 30, 2004, Biegelsen et al.
U.S. Appl. No. 11/109,566, filed Apr. 19, 2005, Mandel et al.
U.S. Appl. No. 11/156,778, filed Jun. 20, 2005, Swift.
U.S. Appl. No. 11/166,299, filed Jun. 24, 2005, Moore.
U.S. Appl. No. 11/166,460, filed Jun. 24, 2005, Roof et al.
U.S. Appl. No. 11/166,581, filed Jun. 24, 2005, Lang et al.
U.S. Appl. No. 11/170,873, filed Jun. 30, 2005, Klassen.
U.S. Appl. No. 11/170,975, filed Jun. 30, 2005, Klassen.
U.S. Appl. No. 11/170,845, filed Jun. 30, 2005, Sampath et al.
U.S. Appl. No. 11/189,371, filed Jul. 26, 2005, Moore et al.
U.S. Appl. No. 11/208,871, filed Aug. 22, 2005, Dalal et al.
U.S. Appl. No. 11/215,791, filed Aug. 30, 2005, Hamby et al.
U.S. Appl. No. 11/234,468, filed Sep. 23, 2005, Hamby et al.
U.S. Appl. No. 11/234,553, filed Sep. 23, 2005, Mongeon.
U.S. Appl. No. 11/222,260, filed Sep. 8, 2005, Goodman et al.
U.S. Appl. No. 11/247,778, filed Oct. 11, 2005, Radulski et al.
U.S. Appl. No. 11/248,044, filed Oct. 12, 2005, Spencer et al.
U.S. Appl. No. 11/287,177, filed Nov. 23, 2005, Mandel et al.
U.S. Appl. No. 11/291,583, filed Nov. 30, 2005, Lang.
U.S. Appl. No. 11/291,860, filed Nov. 30, 2005, Willis.
U.S. Appl. No. 11/274,638, filed Nov. 15, 2005, Wu et al.
U.S. Appl. No. 11/287,685, filed Nov. 28, 2005, Carolan.
U.S. Appl. No. 11/317,589, filed Dec. 23, 2005, Biegelsen et al.
U.S. Appl. No. 11/314,774, filed Dec. 21, 2005, Klassen.
U.S. Appl. No. 11/317,167, filed Dec. 23, 2005, Lofthus et al.
U.S. Appl. No. 11/314,828, filed Dec. 21, 2005, Anderson et al.
U.S. Appl. No. 11/292,338, filed Nov. 30, 2005, Mueller.
U.S. Appl. No. 11/292,163, filed Nov. 30, 2005, Mandel et al.
U.S. Appl. No. 11/312,081, filed Dec. 20, 2005, Mandel et al.
U.S. Appl. No. 11/331,627, filed Jan. 13, 2006, Moore.
U.S. Appl. No. 11/341,733, filed Jan. 27, 2006, German.
U.S. Appl. No. 11/359,065, filed Jan. 22, 2005, Banton.
U.S. Appl. No. 11/349,828, filed Feb. 8, 2006, Banton.
U.S. Appl. No. 11/364,685, filed Feb. 28, 2006, Hindi et al.
U.S. Appl. No. 11/363,378, filed Feb. 27, 2006, Anderson et al.
U.S. Appl. No. 11/378,046, filed Mar. 17, 2006, Rizzolo et al.
U.S. Appl. No. 11/378,040, filed Mar. 17, 2006, German.
U.S. Appl. No. 11/403,785, filed Apr. 13, 2006, Banton et al.
U.S. Appl. No. 11/399,100, filed Apr. 6, 2006, Paul.
U.S. Appl. No. 11/417,411, filed May 4, 2006, DeGruchy.
U.S. Appl. No. 11/432,924, filed May 12, 2006, Lieberman et al.
U.S. Appl. No. 11/432,905, filed May 12, 2006, Mongeon et al.
U.S. Appl. No. 11/432,993, filed May 12, 2006, Anderson.
U.S. Appl. No. 11/487,206, filed Jul. 14, 2006, Wu et al.
U.S. Appl. No. 11/485,870, filed Jul. 13, 2006, Moore.
U.S. Appl. No. 11/474,247, filed Jun. 23, 2006, Moore.
U.S. Appl. No. 11/483,747, filed Jul. 6, 2006, Meetze.
U.S. Appl. No. 11/495,017, filed Jul. 28, 2006, Bean.
U.S. Appl. No. 11/501,654, filed Aug. 9, 2006, Mestha et al.
U.S. Appl. No. 11/522,171, filed Sep. 15, 2006, Sampath et al.
U.S. Appl. No. 11/528,770, filed Sep. 27, 2006, Degruchy.
U.S. Appl. No. 11/545,176, filed Oct. 10, 2006, deJong et al.
U.S. Appl. No. 11/595,630, filed Nov. 9, 2006, Moore.
U.S. Appl. No. 11/590,432, filed Oct. 31, 2006, Moore.
U.S. Appl. No. 11/636,747, filed Dec. 11, 2006, Mestha et al.
U.S. Appl. No. 11/636,901, filed Dec. 11, 2006, Banton et al.
U.S. Appl. No. 11/639,073, filed Dec. 14, 2006, Biegelsen et al.

* cited by examiner

EFFICIENT CROSS-STREAM PRINTING SYSTEM

CROSS REFERENCE TO RELATED APPLICATIONS

The following applications, the disclosures of each being totally incorporated herein by reference are mentioned:

U.S. application Ser. No. 11/166,581, filed Jun. 24, 2005, entitled "MIXED OUTPUT PRINT CONTROL METHOD AND SYSTEM," by Joseph H. Lang, et al.;

U.S. application Ser. No. 11/248,044, filed Oct. 12; 2005, entitled MEDIA PATH CROSSOVER FOR PRINTING SYSTEM, by Stan A. Spencer, et al.;

U.S. application Ser. No. 11/291,583, filed Nov. 30, 2005, entitled MIXED OUTPUT PRINTING SYSTEM, by Joseph H. Lang;

U.S. application Ser. No. 11/292,163, filed Nov. 30, 2005, entitled RADIAL MERGE MODULE FOR PRINTING SYSTEM, by Mandel, et al.

BACKGROUND

The exemplary embodiment relates to sheet transport systems. It finds particular application in a printing system in which output streams of print media traveling in angularly spaced directions from two or more marking engines are merged into a combined stream.

Electronic printing systems, such as laser printers and copiers, typically employ an input terminal, which receives images in digital form, and conversion electronics for converting the image to image signals or pixels. The printing system may include a scanner for scanning image-bearing documents or be connected to a computer network which supplies the digital images. The signals are stored and are read out successively to a marking engine for formation of the images and transfer of the images to a print medium, such as paper.

Cluster printing systems enable high print speeds or print rates by grouping a number of slower speed marking engines in parallel. These systems also enable output to be maintained, albeit at a slower speed, if one marking engine fails, through redirection of a print job to the remaining marking engines. Parallel printing systems have been developed which employ multiple marking engines for black, process (or full) color, and custom color (single color or monochrome) printing of selected pages within a print job. For example one marking engine prints even pages of a print job on one set of sheets while another marking engine prints the odd pages on a second set of sheets. The outputs of the marking engines are automatically combined in page order and delivered to a common finisher, such as an output tray.

Merging sheets from two paths into a single path can be achieved by bringing streams from printers arranged in orthogonal directions to a merge module. However, one problem of such systems is that access to printer components is often difficult. For example, an operator may be required to walk around one of the printers in order to load paper, replace toner cartridges, program jobs, clear paper jams or otherwise operate the system on the other connected printer.

INCORPORATION BY REFERENCE

The following references, the disclosures of which are incorporated herein in their entireties by reference, are mentioned.

U.S. application Ser. No. 11/166,581, filed Jun. 24, 2005, entitled MIXED OUTPUT PRINT CONTROL METHOD AND SYSTEM, by Joseph H. Lang, et al. discloses a merging module which connects two print engines at approximately 90 degrees to one another. The merging module includes a sheet rotator in a plane that is common to the paper paths of both print engines and a buffer which stores printed sheets. The module also includes two bypass paths, one above and one below the rotator, to route the two paper paths around the rotator and enable both print engines to deliver their output to the appropriate finishing device as well as to the buffer.

U.S. Pat. No. 5,090,683, issued Feb. 25, 1992, entitled ELECTRONIC SHEET ROTATOR WITH DESKEW, USING SINGLE VARIABLE SPEED ROLLER, by Kamath, et al., discloses a device for selectively turning documents which includes first and second drive rollers aligned along an axis which is transverse to a process direction along which documents are fed, and first and second follower rollers cooperatively peripherally aligned with the first and second drive rollers, respectively. One of the drive rollers is operated at a substantially constant peripheral velocity by a first drive which is a constant velocity motor while the other drive roller is operated at a variable peripheral velocity by a variable speed drive so that the document is turned. Thus, only a single variable speed drive, such as, for example a stepper motor or servo system, is required. The variable speed drive is driven through a variable velocity profile to control the amount of rotation of the document, such as turning the document approximately 90 degrees. An additional mechanism can be provided for shifting the connection of the constant velocity and variable speed motors between the first and second drive rollers so that a sheet can be rotated in opposite directions.

U.S. Pat. No. 6,607,320, issued Aug. 19, 2003, entitled MOBIUS COMBINATION OF REVERSION AND RETURN PATH IN A PAPER TRANSPORT SYSTEM, by Bobrow, et al., discloses an apparatus for processing a substrate on two sides which includes a reversion pathway adapted to receive a substrate from an input pathway and invert the substrate and return the reverted substrate to the input pathway and a merge point for merging the reverted substrate into the input pathway.

U.S. Pat. No. 6,925,283, issued Aug. 2, 2005, entitled HIGH PRINT RATE MERGING AND FINISHING SYSTEM FOR PRINTING, by Mandel, et al. and U.S. Pat. No. 6,959,165, issued Oct. 25, 2005, entitled HIGH PRINT RATE MERGING AND FINISHING SYSTEM FOR PRINTING, by Mandel, et al. disclose a system for printing media which includes a plurality of marking engines for outputting printed media in a stream, a media path system operable to transport the printed media from the marking engines to one or more finishing stations such that the streams are merged and transported one on top of the other and one or more finishing stations capable of compiling media in groups of two or more sheets for post-processing the printed media into one or more completed jobs.

U.S. Pat. No. 6,973,286, issued Dec. 6, 2005, entitled HIGH RATE PRINT MERGING AND FINISHING SYSTEM FOR PARALLEL PRINTING, by Mandel, et al., discloses a system for printing media includes a plurality of marking engines for outputting printed media in a stream, a media path system operable to transport the printed media from the marking engines to one or more finishing stations such that the streams are merged and transported one on top of the other and one or more finishing stations capable of compiling media in groups of two or more sheets for post processing the printed media into one or more completed jobs.

U.S. Pat. No. 7,024,152, issued Apr. 4, 2006, entitled PRINTING SYSTEM WITH HORIZONTAL HIGHWAY AND SINGLE PASS DUPLEX, by Lofthus, et al., discloses a parallel printing system which includes first and second adjacent electronic printers and at least one sheet bypass section extending around the second electronic printer to provide a sheet transporting path overlying the second electronic printer and bypassing the second electronic printer. The sheet bypass section includes an output for merging printed sheets from the first electronic printer with printed sheets printed by the second electronic printer.

U.S. Publication No. 2004/0253033, published Dec. 16, 2004, entitled UNIVERSAL FLEXIBLE PLURAL PRINTER TO PLURAL FINISHER SHEET INTEGRATION SYSTEM, by Lofthus, et al., discloses a multifunction printed sheets interface system with sheet input areas for receiving printed sheets and outputs areas for outputs to different sheet processing systems. A sheet transporting system provides selectable sheet translation from selected plural sheet input areas to selected plural sheet outputs areas so as to provide selectable sheet feeding from selected printers to selected sheet processing systems, and selectable sheet rotation of selected sheets and selectable sheet merging in a selected sheet sequence of sheets from plural printers. The sheet transporting system has a large planar area with a multiplicity of spaced apart independently operable variable sheet feeding direction and sheet velocity sheet transports, larger than the dimensions of any sheet to be fed thereon to allow simultaneous plural sheet variable transport thereon.

U.S. Publication No. 2006/0033771, published Feb. 16, 2006, entitled PARALLEL PRINTING ARCHITECTURE CONSISTING OF CONTAINERIZED IMAGE MARKING ENGINES AND MEDIA FEEDER MODULES, by Lofthus, et al., discloses an integrated printing system includes two image marking engines, a media feeder module, and a first forward generally horizontal interface media transport between the two image marking engines and feeder module for transporting media from the media feeder module to one of the image marking engines.

U.S. Publication No. 2006/0114497, published Jun. 1, 2006, entitled PRINTING SYSTEM, by Anderson, et al., discloses a printing system which includes both monochrome and color marking engines and a previewer, which identifies, for each page of a print job, whether the page includes a color image, and a scheduler, responsive to the previewer for assigning pages of the print job among the marking engines based on the attributes of the print job and a user-selected print mode and at least one marking engine controller, in communication with the scheduler, for controlling the at least one monochrome marking engine to render pages of the print job assigned thereto and for controlling the at least one color marking engine to render pages of the print job assigned thereto.

The following references relate to what have been variously called "tandem engine" printers, "parallel" printers, or "cluster printing" (in which an electronic print job may be split up for distributed higher productivity printing by different printers, such as separate printing of the color and monochrome pages), and "output merger" or "interposer" systems: U.S. Pat. No. 5,568,246 to Keller, et al., U.S. Pat. No. 4,587,532 to Asano, U.S. Pat. No. 5,570,172 to Acquaviva, U.S. Pat. No. 5,596,416 to Barry, et al.; U.S. Pat. No. 5,995,721 to Rourke et al; U.S. Pat. No. 4,579,446 to Fujino; U.S. Pat. No. 5,489,969 to Soler, et al.; a 1991 "Xerox Disclosure Journal" publication of November-December 1991, Vol. 16, No. 6, pp. 381-383 by Paul F. Morgan; and a Xerox Aug. 3, 2001 "TAX" publication product announcement entitled "Cluster Printing Solution Announced."

BRIEF DESCRIPTION

In accordance with one aspect of the exemplary embodiment, a printing system includes a first marking engine which outputs marked print media to a first print stream, the first marking engine defining, at least in part, a first side of a working area. A second marking engine outputs marked print media to a second print stream which is angled to the first print stream. The second marking engine defines, at least in part, a second side of a working area whereby a user has access to the first and second marking engines via access members on the first and second sides of the working area. A merge module receives print media from the first and second print streams, the merge module including at least one rotate and redirect path for merging print media from one of the first and second streams with print media from the other of the first and second streams to generate a merged print stream. At least one finisher receives the merged print stream from the merge module.

In accordance with another aspect, a method of printing includes outputting marked print media from a first marking engine to a first print stream, the first marking engine defining, at least in part, a first side of a working area. The first stream of marked print media is transported to a merge module via an overhead transport which overlies the first marking engine. Marked print media is output from a second marking engine to a second print stream which is substantially orthogonal to the first print stream. The second marking engine defines, at least in part, a second side of a working area whereby a user has access to the first and second marking engines via access members on the first and second sides of the working area. The first and second streams are merged in the merge module to generate a merged print stream.

In accordance with another aspect, a method of operating a printing system is provided. The printing system includes first and second marking engines having access members which define, at least in part, respective first and second vertically extending sides of a generally triangular working area, the first and second marking engines outputting respective first and second streams of print media to a common merge module located at an apex of the triangular working area. The method includes accessing the first marking engine from the working area by manipulating the first access member and, without leaving the working area, accessing the second marking engine by manipulating the second access member, whereby components of the first and second marking engines are accessible for at least one of maintenance, repair, adjustment, and replacement from the working area.

DETAILED DESCRIPTION

Figure 1:
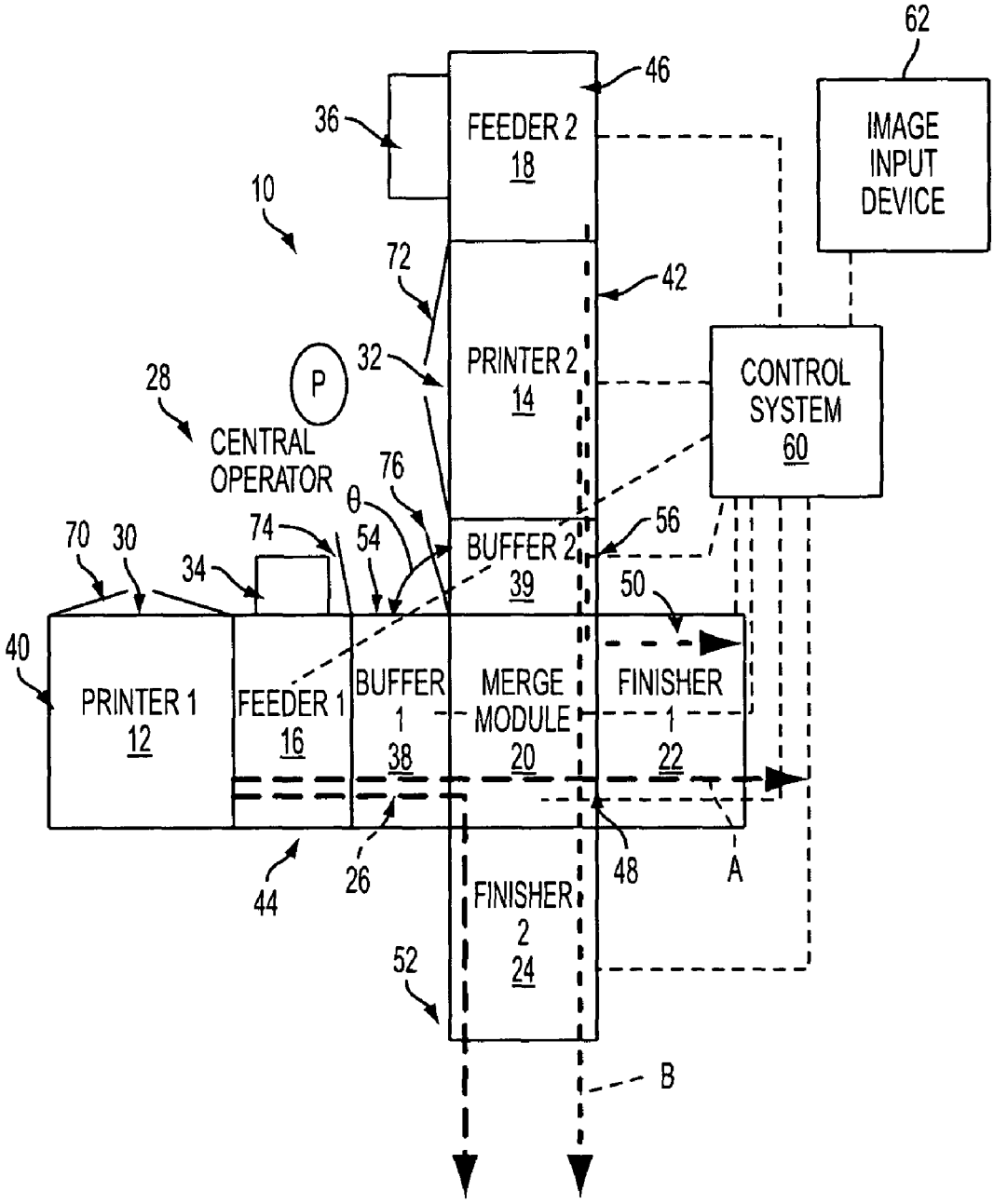
FIG. 1 is a top plan view of a printing system in accordance with the exemplary embodiment.

Aspects of the exemplary embodiment relate to a printing system which provides operator access to multiple printers from a single location. In various aspects, the printing system includes a media path such that the sheets printed by a plurality of printers can cross over each other or be merged into a single stream, at a location upstream of one or more finishers.

In various aspects, a pair of printers is arranged in a cross stream configuration in a physically efficient manner by configuring the system such that an operator can be located centrally to the equipment. This avoids the need for an operator to walk around one of the printers to gain access. In some aspects, two left-to-right (or two right to-left) printers are arranged at substantially 90° to each other such that the operator can be located in a central position from where there is convenient access to two sets of controls, paper trays, and jam clearance access doors, and other printer components so that both printers can be operated efficiently.

The exemplary printing system includes a plurality of printers and may include a variety of other components, such as finishers, paper feeders, and the like. The printing system may be embodied as a copier, printer, or a multifunction machine. The term "printer" or "marking engine" generally refers to a device for applying an image to print media. "Print media" can be a physical sheet of paper, plastic, packaging material, electronic circuit board, or other suitable physical print media substrate for images. A "print job" or "document" is normally a set of related sheets, usually one or more collated copy sets copied from a set of original print job sheets or electronic document page images, from a particular user, or otherwise related. An image generally may include information in electronic form which is to be rendered on the print media by the marking engine and may include text, graphics, pictures, and the like. While the exemplary printing system is described with particular reference to a xerographic printing system in which the colorants comprise dry toners applied in an electrophotographic process, it is also contemplated that the exemplary embodiment is also applicable to other types of printing system. For example, the printing system may employ liquid or solid inks or other colorants, such as an inkjet printer, or be an offset printing system. A "finisher" can be any post-printing accessory device such as a tray or trays, sorter, mailbox, inserter, interposer, folder, stapler, stacker, hole puncher, collator, stitcher, binder, envelope stuffer, postage machine, or the like. The operation of applying images to print media, for example, graphics, text, photographs, etc., is generally referred to herein as printing or marking.

The printing system of the exemplary embodiment may incorporate many of the features of printing systems employing multiple marking engines as disclosed, for example, in co-pending application Ser. Nos. 11/166,581; 11/248,044; 11/291,583; and 11/292,163, incorporated herein by reference. For example, the exemplary printing system may include two (or more) marking engines, where each of the marking engines may be of the same mode, such as monochrome (single color, e.g., black), color (multi-color) or magnetic ink character recognition (MICR). Or, the printing system may be mixed mode, e.g., one color and one monochrome marking engine or other combination of different marking engines.

The exemplary printing system may be configured as a plurality of interconnected modules. In this embodiment, components of the printing system, such as marking engines, paper sources, buffers, merge module(s), finishers, and interconnecting media paths, are configured as separate, removable, and interchangeable modules. Each module may be housed by a respective housing, which may be supported on wheels, rollers, or other transport members for manipulating the module across a floor surface. In the exemplary embodiment, the printing system components are arranged in a substantially orthogonal arrangement whereby the marking engines are arranged at about 90 degrees (e.g., about 90±20 degrees) to each other in an X-shaped layout such that their output paths intersect. A module which is common to the output paths of both marking engines, referred to herein as a merge module, is positioned at the intersection of the two output paths. In the exemplary embodiment, the merge module enables print streams from both marking engines to pass simultaneously through it and/or allows one of the print streams to be rotated and merged into the other print stream.

An advantage of such a modular printing system is that it can be reconfigured, e.g., by adding, removing, or exchanging modules, to accommodate the changing demands of a printing business or for replacement and/or repair of components.

With reference to FIG. 1, a block diagram of a first embodiment of a radial merge printing system 10 according to the exemplary embodiment is illustrated. The printing system 10 includes first and second marking engines 12, 14, each with an associated print media source, such as a paper feeder 16, 18, a merge module 20, and one or more output destination(s) 22, 24, all interconnected by interconnected paper paths, along which the media is conveyed by a print media conveyor system 26. The illustrated output destinations 22, 24 are both finishers, although it is also contemplated that one or both of the output destinations may be marking engines or that only a single output destination is provided.

The print media conveyor system 26 is controllable to acquire sheets of a selected print medium from the print media sources 16, 18, transfer each acquired sheet to the associated marking engine 12, 14 to perform selected marking tasks, and then transfer each sheet to a finisher 22, 24 to perform finishing tasks.

The printing system 10 executes print jobs. Print job execution involves printing images, such as selected text, line graphics, photographs, magnetic ink character recognition (MICR) notation, and the like on front, back, or front and back sides or pages of one or more sheets of paper or other print media. Some sheets may be left completely blank. Some sheets may have both color and monochrome images. Execution of the print job may also involve collating the sheets in a certain order. Still further, the print job may include folding, stapling, punching holes into, or otherwise physically manipulating or binding the sheets. The printing, finishing, paper handing, and other processing operations that can be executed by the printing system 10 are determined by the capabilities of the paper sources 16, 18, marking engines 12, 14, and finisher(s) 22, 24 of the printing system 10. These capabilities may increase over time due to addition of new components or upgrading of existing components. The capabilities may also decrease over time due to failure or removal of one or more components, such as the failure of one of the marking engines 12, 14. Until a repair or replacement can be effectuated, a print job may be handled by the remaining marking engine(s).

The printing system 10 is an illustrative example. In general, any number of print media sources, media handlers, marking engines, finishers or other processing units can be connected together by a suitable print media conveyor configuration. In some embodiments, one of finishers 22, 24 may be omitted or replaced with another marking engine which feeds its output to a downstream finisher.

The marking engines 12, 14 illustrated in FIG. 1 are arranged to output a respective print stream of printed media, illustrated by arrows A and B, which travel away from the respective marking engine in mutually orthogonal directions. The marking engines are also arranged orthogonally. A generally triangular working area 28, defined in part by access sides 30, 32 of the marking engines 12, 14, and extending to an apex adjacent the merge module 20, provides an operator, positioned generally at location P, with access to both of the marking engines 12, 14 and optionally also to other components such as print media supply trays 34, 36 of paper feeders 16, 18, for repair, replacement of components, replenishment of print media, and the like.

Print media is conveyed from the respective print media source 16, 18, to the marking engines 12, 14, where it is marked. The streams of marked print media are transported by the conveyor system 26 from the marking engines 12, 14 to the merge module 20, where the streams may be combined or may cross over each other depending on the requirements of a print job. The conveyor system 26 conveys the print media between the merge module 20 and one or both of the output destinations 22, 24. Optionally, one or more sheet buffers 38, 39 are provided intermediate a respective marking engine and the merge module. The buffers each allow one or more printed sheets to be sheets to be stored prior to entering the merge module. A multi-sheet buffer which may be employed as buffers 38, 39 is described, for example, in above-mentioned application Ser. No. 11/166,581, incorporated by reference. Each buffer 38, 39 may include a plurality of buffer paths, each long enough to contain the largest sheet length entirely and controllable decision gates to direct sheets to enter a buffer path upon demand. All of the buffer paths may merge to an exit transport to enter the merging module 20. As represented by the arrow A, sheets may enter the multi-sheet buffer 38 from the first marking engine 12, while sheets may enter the multi-sheet buffer 39 from the second marking engine 14, in the direction of arrow B. Buffer 38 is physically interposed between sheet feeder 16 and merge module 20.

The printing system components 12, 14, 16, 18, 20, 22, 24, 38, 39 may each be in the form of a separate module, optionally with a respective wheeled housing 40, 42, 44, 46, 48, 50, 52, 54, 56, which houses/supports the respective component. In other embodiments, two or more of these components may be in the same housing.

The operation of some or all the printing system components 12, 14, 16, 18, 20, 22, 24, 26, 34, 36, 38, 39 of the printing system 10 may all be under the control of a common control system 60. In particular, the control system 60 may execute processing instructions stored in memory whereby sheets of print media are routed through the printing system 10 in the execution of a print job. A print job or jobs can be selectively distributed by the control system 60 to one or both marking engines 12, 14 for printing. While two marking engines 12, 14 are illustrated, the number of marking engines can be any number, such as one, two, three, four, five, six, or more. Providing at least two marking engines typically provides enhanced features and capabilities for the printing system, since marking tasks can be distributed amongst the at least two marking engines. Some or all of the marking engines 12, 14 may be nominally identical to provide redundancy or improved productivity through parallel printing. Alternatively or additionally, some or all of the marking engines 12, 14 may be different to provide different capabilities. For example, the marking engines 12, 14 may be multicolor, e.g., process color (P) marking engines, monochrome engines, such as black (K), custom color (C), or magnetic ink character recognition (MICR) marking engines, or combinations thereof. It is also contemplated that the marking engines may print packaging or electronics. The marking engines 12, 14 may have the same print speed (in terms of prints per minute, ppm), or different print speeds.

For example, in one mode of printing, both marking engines print pages of the same print job. In a simplex job (where only one side of each sheet is printed), for example, where both marking engines are of the same mode, marking engine 12 may print alternate pages, such as the even pages, while marking engine 14 prints the odd pages. The pages are collated in page order at the finisher 22 or 24. In a duplex job, for example, marking engine 12 prints both sides of a first, third, fifth sheet, etc., while marking engine 14 prints both sides of a second, fourth, sixth sheet, etc. Where one marking engine is a color marking engine and the other a monochrome engine, the color pages may be routed to the color marking engine and the black only pages to the monochrome engine. In another printing mode, both marking engines may be simultaneously printing a print job, the two print jobs being routed to respective finishers.

In general, the control system 60 receives incoming print jobs from an image input device 62. The image input device can include a built-in optical scanner, which can be used to scan a document such as book pages, a stack of printed pages, or the like, to create a digital image of the scanned document that is reproduced by printing operations performed by the printing system 10. Alternatively or additionally, the image input device 62 can include a link to a remote source. For example, a print job can be electronically delivered to the control system 60 via a wired or wireless connection to a digital network that interconnects, for example, personal computers or other digital devices. Other input devices 62 are also contemplated, such as a camera, memory storage device, or computer device, which may be connected directly to the printing system or linked thereto.

Figure 2:
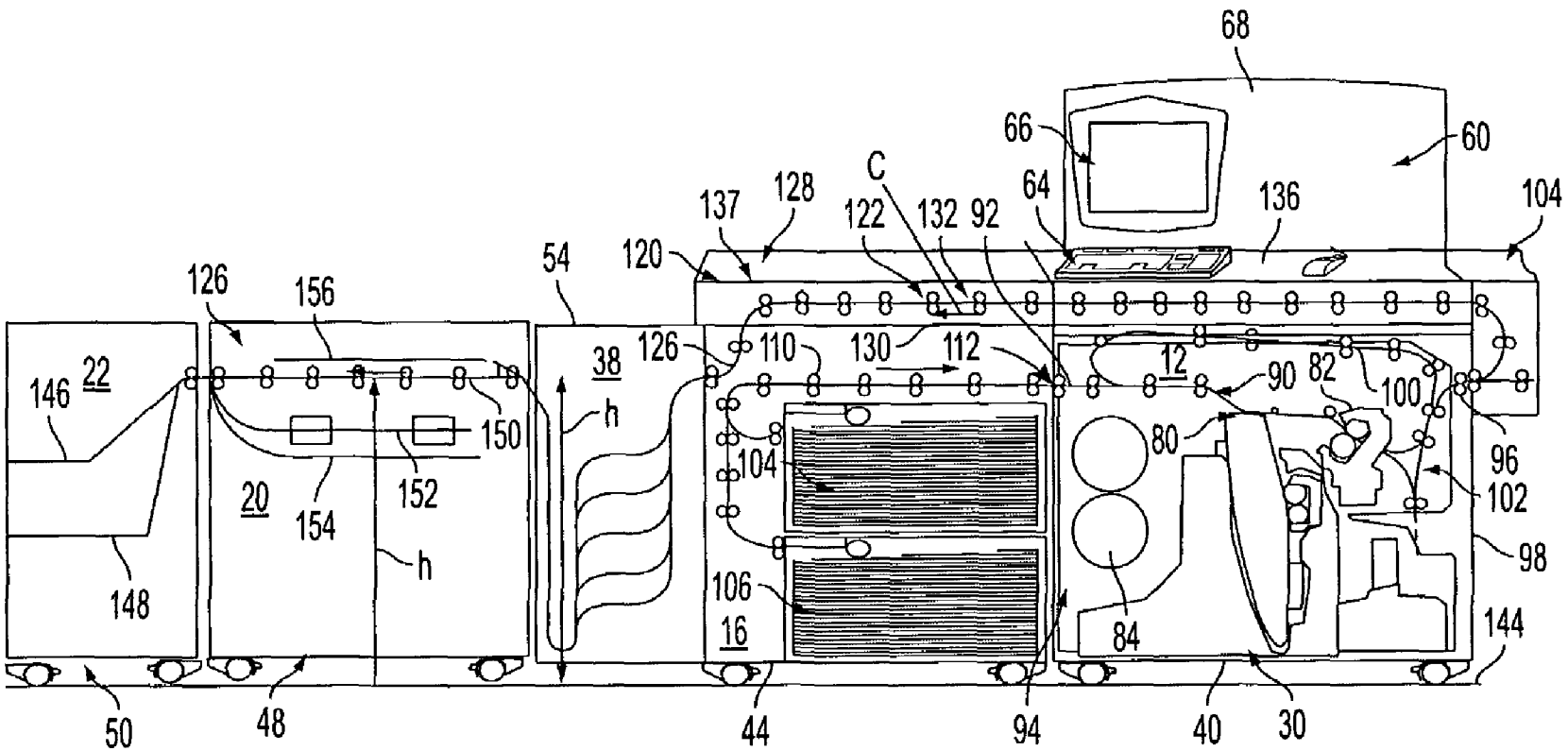
FIG. 2 is a side elevational view of a first paper path incorporating a first of the marking engines of the printing system of FIG. 1.

As illustrated in FIG. 2, the control system 60 receives operating instructions via a user interface comprising a user input device, such as a keyboard 64, and a display 66, such as an LCD screen, facing the working area 28. An operator can control the operation of both printers from the user interface. The display may be mounted above the marking engine 12, e.g., on a rear panel 68, which may also house the control system 60.

The control system 60 may include software components which execute processing instructions for converting the incoming print job into digital pages in a form which can be rendered by one or both marking engines. The control system may also schedule printing of the print job such that the printed pages are output in page order at a selected finisher or finishers.

As shown in FIG. 1, the printing system 10 is configured to allow access to the marking engines 12, 14, feeders 16, 18, and other components of the printing system, while allowing both marking engines to be similarly configured, i.e., with an input from the feeder at the same end of the marking engine, as viewed from the access side. The operator may perform a variety of functions from the working area, including job programming of both marking engines, maintenance, repair, adjustment, replacement, and supplies and consumables replenishment operations from the working area. The operator readily accesses the feed trays 34, 36 and marking engine subcomponents arranged along the two sides of the working area. In particular, the housings 40, 42, 44, 46, 54, 56 of the various modules may limit access to the components therein by covering them, e.g., on three of their four vertical sides. Access members on the fourth vertical side, such as doors 70, 72, 74, 76 in housings 40, 42, 54, 56 of the marking engines 12, 14 and buffers 38, 39 and/or other access members, such as drawers 34, 36, and/or movable or removable access panels, allow access to the paper trays, marking engine subcomponents, feeders, and buffer subcomponents, such as consumer replaceable units (fusers, toner supply containers, etc.), baffles and jam clearance guides, paper transports, and the like. The user Interface is accessible for job programming, jobs queue management, service and supplies management, diagnostics, jam clearance, messages and the like. Supplies replenishment may include filling toner dispenser bottles, emptying waste toner bottles, replenishment of fuser oil, and the like. Adjustments may include decurler adjustments, adjustments to paper size settings, and the like. Access to the paper feeder allows jam clearance (access to baffles), supplies replenishment (add or change paper), consumables replacement (paper feed rolls), and adjustments (paper size/weight settings), and the like.

For example, doors 70, 72 on the access sides 30, 32 of the marking engines define, in part, the sides of the working area 28 and may open into the working area.

With reference to FIG. 2, which shows an exemplary embodiment of a first of the marking engines 12, by way of example, with the access doors 70 removed for clarity, the marking engines 12, 14 may both employ xerographic printing technology, in which an electrostatic image is formed and coated with a toner material, and then transferred and fused to paper or another print medium by application of heat and/or pressure. However, marking engines employing other printing technologies can be provided as processing units, such as marking engines employing ink jet transfer, thermal impact printing, or the like.

In the case of a xerographic device, each marking engine 12, 14 includes various xerographic subsystems for forming an image, transferring the image to a sheet of paper, and fusing the image to attach the image more permanently to the print media. The marking engine typically includes an image applying component, illustrated schematically at 80, which includes a charge retentive surface, such as a rotating photoreceptor in the form of a belt or drum. The images are created on a surface of the photoreceptor. Disposed at various points around the circumference of the photoreceptor are the xerographic subsystems, which include a cleaning device, a charging station for each of the colors to be applied (one in the case of a monochrome marking engine, four in the case of a CMYK printer), such as a charging corotron, an exposure station, which forms a latent image on the photoreceptor, such as a Raster Output Scanner (ROS) or LED bar, a developer unit, associated with each charging station for developing the latent image formed on the surface of the photoreceptor by applying a toner to obtain a toner image, a transfer unit, such as a transfer corotron, transfers the toner image thus formed to the surface of a print media substrate, such as a sheet of paper. A fuser 82 fuses the image to the sheet. The fuser generally applies at least one of heat and pressure to the sheet to physically attach the toner and optionally to provide a level of gloss to the printed media. In any particular embodiment of an electrophotographic marking engine, there may be variations on this general outline, such as additional corotrons, cleaning devices, or, in the case of a color printer, multiple developer units. The xerographic subsystems are controlled by a marking engine controller, such as a CPU, which includes actuators for controlling each of the subsystems. The marking engine controller is linked to the control system 60 and may be also linked to other known components, such as a memory, a marking cartridge platform, a marking driver, a function switch, a self-diagnostic unit, all of which can be interconnected by a data/control bus.

The marking engine 12 includes a number of customer replaceable units including the fuser assembly 82, toner supply containers 84, a waste container 86, and the like, which are accessible through open side 30 of the marking engine.

The marking engine 12 has a media path 90 which extends between an inlet 92, at a first end 94 of the housing 40, and an outlet 96, at the opposite end 98 of the housing. Print media is fed by the feeder module to the inlet 92 and is carried by path 90 to the image applying component 80 and fuser 82 and thereafter to the outlet 96. The illustrated marking module 12 can thus be defined as a left-to-right device, as viewed from the access side 30, because the print media enters at the left and leaves at the right of the module. In one embodiment, a duplex pathway 100 provides a return loop which returns marked print media to the image applying component 80 for further printing. For example, when the marking engine 12 operates in a duplex mode, print media which has been marked in the marking engine is inverted by an inverter 102 and passed through the marking engine a second time for printing on the second side of the sheet.

Each feeder module 16, 18, may include a plurality of print media trays 104, 106, which are connected with the print media conveyor system 26 to provide selected types of print media to all of the marking engines 12, 14. While two print media source trays are illustrated, the number of source trays can be one, two, three, four, five, or more. Each of the print media source trays can store sheets of the same type of print medium, or can store different types of print media. The feeder module includes a paper path 110, which carries the print media from the trays to an outlet 112, at an end of the module which is upstream of the marking engine inlet 92. In other embodiments, the feeder module may be incorporated into the marking engine module, e.g., in the same housing.

In the case of marking engine 12, a transport section 120 conveys marked media from the marking engine 12 toward the merge module 20. In particular the transport section 120 may be positioned on top of the marking engine 12 and may also extend across the top of the feeder module 16. The transport section 120 thus serves as an overhead transport which defines a paper path 122 that transports the marked sheet from the marking engine output 96 over the marking engine module to connect with the merge module 20, for example, via a media path 126 which passes through the feeder module 16. The transport section 120 thus transports the print media in a direction generally opposite to and in parallel with the direction in which print media travels from the feeder module 16 to the marking module 12. In other embodiments, the transport section 120 may be located below the marking engine and feeder modules.

The transport section 120 may be configured as a modular component which can be added to the marking engine 12 or removed therefrom as needed. This allows marking engines 12, 14 to be identically configured if desired and interchangeable with each other, simply by interchanging their positions and installing the transport section 120 on the appropriate one of the marking engines.

The illustrated transport section 120 is configured as a box which includes spaced upper and lower baffle plates 128, 130. The baffle plates may be joined by side walls (not shown) and define the paper path 122 therebetween. The transport section includes a plurality of drive members 132 which convey the printed sheets generally horizontally in a downstream direction, as illustrated by arrow C, above the marking engine 12. The drive members 132 in the overhead transport, and optionally also elsewhere in the conveyor system 26, can include for example, rollers, airjet transport modules, spherical nips ("SNIPS") spin-roller drives, omni-directional drive systems, and the like. In the illustrated embodiment, the overhead transport includes at least two pairs of laterally spaced driven rollers. The upper baffle plate may provide a top jam access cover which allows access to the media path for clearing jams. A connecting transport 134, which provides a 180° turn from the module outlet 96 to the media path 122, may be integral with the overhead transport 120 or separable therefrom and, like the overhead transport, may be a modular, removable component. The connecting transport 134 may be attached to the upstream end of the overhead transport 120.

As for the overhead transport section 120 of the conveyor system 26, the rest of the conveyor system may include baffles (not shown), which constrain the print media to move along paper paths, and associated drive elements such as rollers, spherical balls, or air jets, which convey the print media along the paths. The conveyor system 26 may include diverters, inverters, interposers, and the like, as known in the art.

The illustrated overhead transport 120 overlies both the marking engine 12 and the feeder module 16. In one embodiment, the overhead transport is configured as two mating sections 136, 137, one for installing over the marking engine 12, the other for installing over the feeder module 16. On one embodiment, the overhead transport 120 may extend over other modules intermediate the feeder module and merge module 20, such as over buffer module 38.

Figure 3:
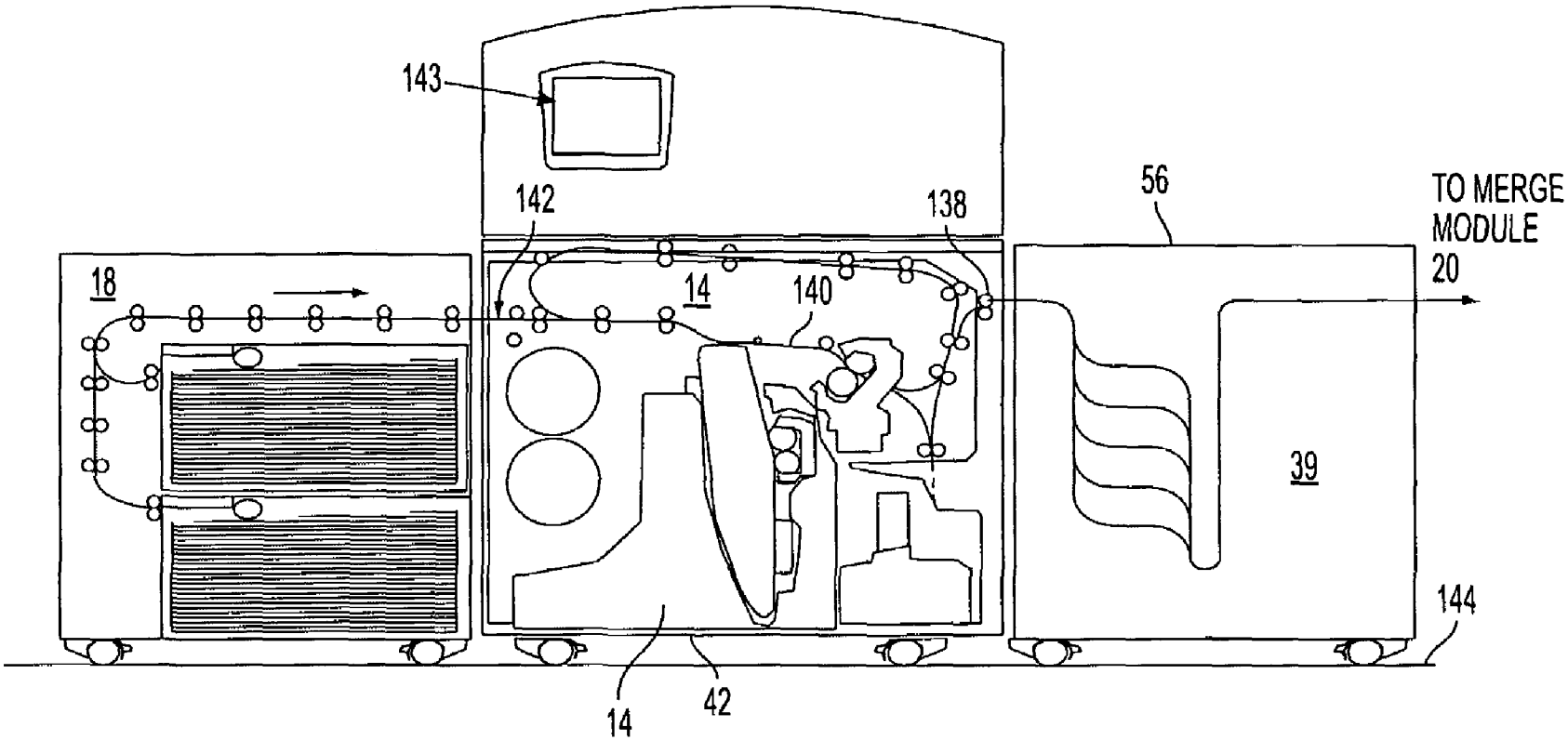
FIG. 3 is a side elevational view of a second paper path incorporating a second of the marking engines of the printing system of FIG. 1.

The marking engine module 14, which may be configured analogously to marking engine 12 as a left-to-right marking engine, is shown in FIG. 3. An output end 138 of its print media path 140 is connected with the buffer module 39, where present, or where there is no buffer module, the output end 138 may be connected directly with the merge module 20. The feeder module 18 is directly adjacent an input end 142 of the marking module 14. Thus, the marking engine 14 is interposed between the feeder module 18 on one side and the downstream components (buffer 39, merge module 20, finishers 22, 24, etc.) on the other, whereas in the case of marking module 12, the feeder module 16 is interposed between the marking module 12 and the downstream components 38, 20, 22, 24. The marking engine 14 may be under the control of the same control system 60 as marking engine 12. In some embodiments, the marking engine 14 may be provided with its own user interface, e.g., comprising a display 143 and/or keyboard, analogous to display 66 and keyboard 64 of marking engine 12.

The finishers 22, 24 may each be in the form of a module which includes one or more print media output destinations illustrated in FIG. 2 by trays 146, 148. While two output destinations 146, 148 are illustrated in the finisher 22 of FIG. 2, the printing system 10 may include one, two, three, four, or more print media output destinations.

The merge module 20 may be configured, for example, as described in above-mentioned Ser. Nos. 11/292,163 and 11/166,581. As shown in FIG. 1, the first and second streams A, B of print media arrive at the merge module 20 from angularly spaced directions. Specifically, the marking engines 12, 14 are oriented to each other at an angle θ of approximately 90° (e.g., from about 70° to about 110°), such that the respective output streams A, B exit the marking engines in directions, which are also angularly spaced at approximately 90°, and arrive at the merge module 20 in the same relative orientations. As illustrated in FIGS. 2 and 3, outputs 96, 138 of the two marking engines 12, 14 (and/or buffer modules 38, 39) may be in the same plane—i.e., at generally the same height h above a support surface 144, such as the ground.

Figure 4:
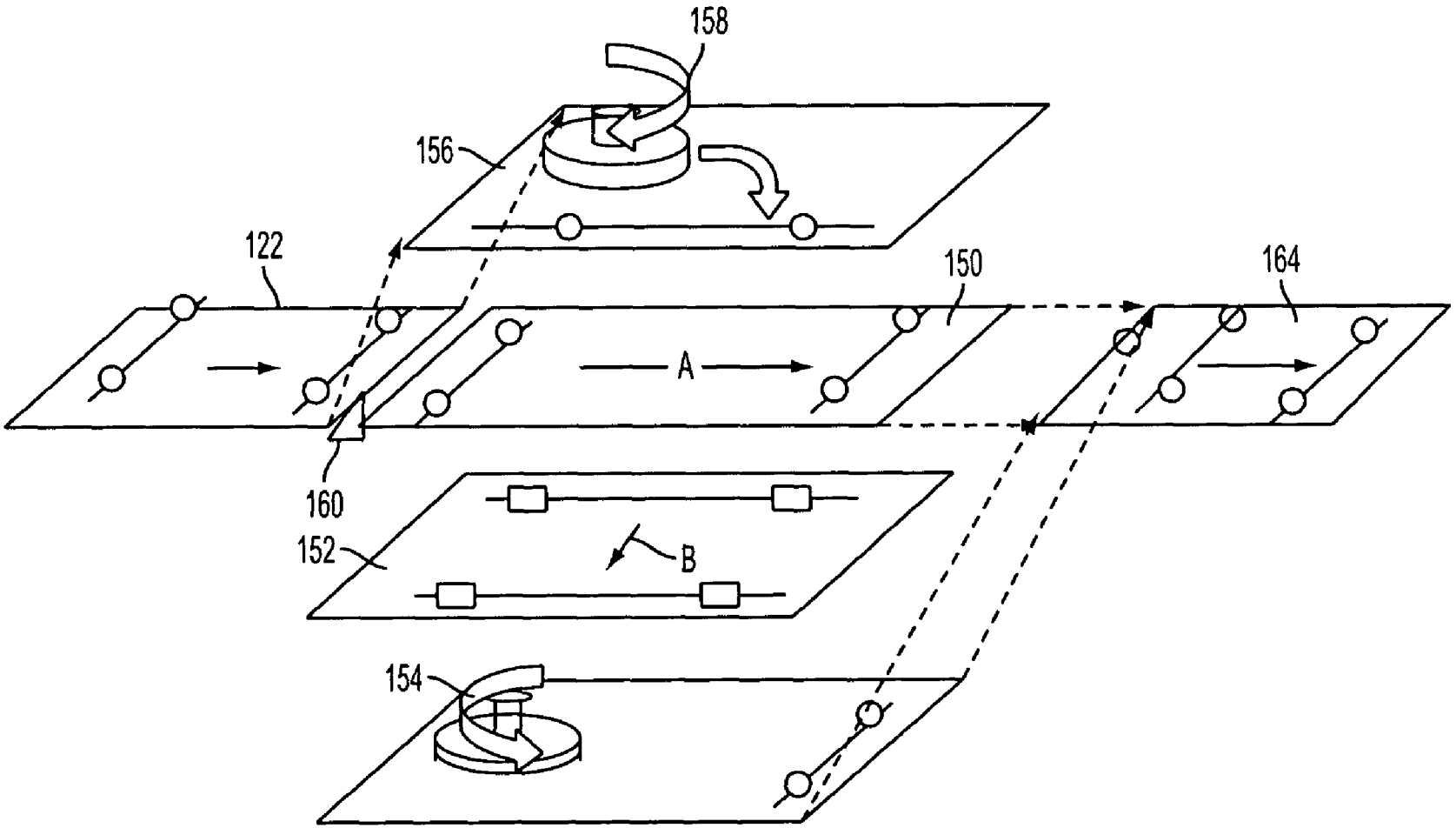
FIG. 4 is a schematic perspective view illustrating the paper pathways through the merge module of FIG. 1.

The merge module 20 provides at least one rotate and redirect path for merging print media from one of the first and second streams with print media from the other of the first and second streams to generate a merged print stream. In one embodiment, the merge module 20 operates to align the direction of output streams A and B so that they have the same direction and velocity. The merged stream may be aligned in the same direction as one of the input streams (in FIG. 1, stream A or B) although it is also contemplated that the merged stream may be output in a different angular direction from both input streams. The merge module may also provide for through passage of stream A and/or B. The merge module may be configured as described for example, in either of application Ser. Nos. 11/166,581 and 11/292,163, incorporated by reference. For example, as illustrated in FIG. 4, the merge module 20 may include four media transport sections 150, 152, 154, 156 which provide four separate paths for print media: a first, media transport section 150, which defines a first print media transport plane for through passage of print media in the direction of arrow A, a second, media transport section 152, which defines a second print media transport plane for through passage of print media in the direction of arrow B, and third and fourth media transport sections 154, 156, which may be located below and above the through passage planes, respectively. The third and fourth transport sections define third and fourth print media transport planes, spaced from the first and second planes, for selectively rotating sheets through a predetermined angle in the plane of the sheet and redirecting the sheets along a path angled to the input path. The illustrated first, second, third, and fourth media transport sections are vertically stacked, one on top of the other, i.e., spaced apart and generally parallel with each other to define the four spaced transport planes in which print media can be conveyed contemporaneously.

In alternate embodiments, the merge module may include three parallel transport sections, the first two being configured for through passage as for sections 150 and 152, and the third for receiving print media from at least one of stream A and stream B and rotating it. In other embodiments, transport sections 150 and 152 may be configured for selectively rotating sheets or allowing through passage, in which case, transports 154, 156 may be omitted. In yet other embodiments, two or more of the media transport sections may be arranged in other orientations.

The sections 150, 152, 154, and 156 are each sized to accommodate one or more sheets of print media and include drive members for conveying the sheets. The rotation sections 154, 156 include drive members which serve to draw the sheet onto the section, decelerate the sheet, stop it, then rotate the sheet, and finally accelerate the sheet to normal speed. Exemplary sheet rotation transports 154, 156 include a drive wheel 158, which rotates in a plane parallel to the sheet to turn the sheet through 90 degrees. Suitable sheet rotation transports of this type are available from C. P. Bourg, such as the Bourg Sheet Rotator (BSR).

Other rotation transports operate by preferential actuation of one of a pair of drive members. One exemplary system includes pairs of driven rollers, one pair angled at 90 degrees to the other pair. The first pair conveys the sheet into the center of the plane and then decelerates and stops the sheet temporarily. The second pair then grasps the sheet and accelerates it in the new direction. Rotation transports of this type are described, for example, in application Ser. No. 11/292,163. It is also contemplated that rotation sections 154 and 156 may each include two rotation sections, with sheets being alternated between the two, as described, for example, in application Ser. No. 11/292,163.

The drive systems in sections 150, 152, 154, and 156 (and optionally also elsewhere in the conveyor system) can additionally or alternatively include airjet transport modules, spherical nips ("SNIPS") spin-roller drives, omni-directional drive systems, spherical paper moving devices, simple drive nip systems located at 90 degrees to one another with nip releases to selectively engage or disengage one set of drive nips, or independently controlled drive rollers which enable sheet translation and optionally rotation. Examples of such drive systems are described, for example, in U.S. Published Application Nos. 2004/0253033 and 2006/0012102, and in U.S. Pat. No. 5,090,683, incorporated herein by reference in their entireties. An airjet transport system, for example, is generally a paper transport system that uses flowing air instead of rollers to apply the motive force to the paper sheets to move the flexible sheet. The system controller 60 interacts with individual or local module controllers for the various airjets. By adjusting the pressure and/or direction of the airjets, and/or by selectively actuating different groups of airjets, sheets can be transported, redirected, and/or rotated through variable angle sheet driving directions. The airjets can provide a variable velocity as well as a variable angle sheet movement system.

An example of a SNIPS paper moving device for two-axis sheet movement and/or rotation is described in U.S. Pat. No. 6,059,284 to Wolf, et al., the disclosure of which is incorporated herein by reference in its entirety. Each SNIPS sheet drive has a spherical frictional drive ball engaging any overlying sheet, which drive ball is rotated in any desired direction and speed by two orthogonal servo-driven rollers drivingly engaging the opposite side of the ball. Similar transport systems which may be employed are disclosed in U.S. Pat. No. 4,836,119 to Siraco, et al., and U.S. Pat. No. 6,241,242 to Munro, incorporated herein by reference in their entireties. Overlying idler balls, pneumatic pressure or suction, or other known paper feeding normal force systems may be added, if desired, to hold the sheets down against the drive balls in addition to sheet gravity.

The airjet transport, spherical nips, and omni-direction drives are all examples of transport mechanisms which are capable of moving a sheet in any direction in a plane defined by mutually perpendicular X and Y axes as well as rotation, within the plane, through any angle (i.e., three degrees of freedom). These embodiments can move the part in any direction, including velocity direction, at any time, not just the axes perpendicular to the roller axis as in traditional transport systems.

In a roller system, the angle through which rotation/redirection occurs in the plane may be more limited, for example, sheets may be rotated through a preselected angle, such as 90° and/or redirected from a first direction to a second direction perpendicular to the first direction. Or, two-way rollers (where one set of rollers is angled to another set) may permit motion in directions at non-perpendicular angles to the roller axle. In one embodiment, a number of rollers are grouped into perpendicular arrays so that a force in any one direction within the plane can be exerted on the object by appropriate torque applied to the rollers in one of the two orthogonal directions, while opening or releasing the rollers in the other direction using solenoids, cams, or other actuators. The object is free to move in the direction of the closed and driven rollers.

Examples of other drive systems that can be used in the transport sections 150, 152, 154, and 156 for redirection and/or rotation of sheets are disclosed, for example in above-mentioned U.S. Pat. Nos. 6,607,320, 6,554,276, 5,090,683, 5,931,462, 6,811,152, and 5,836,439, incorporated herein by reference.

As illustrated in FIG. 4, a decision gate 160, adjacent upstream ends of sections 150, 156, under the control of the control system 60, selectively direct print media from stream A to one of sections 150, 156. Similarly a decision gate (not shown) selectively directs print media from stream B to one of sections 152, 154. Streams from sections 150, 154 can be merged into a common stream A in a transport section 164, downstream of the merge module, which conveys the merged stream to finisher 22 (or which may be incorporated into the finisher). Similarly streams of print media from sections 152, 156 can be merged into a common stream B in a transport section (not shown) downstream of the merge module, which conveys the merged stream to finisher 24. For given print job, all the sheets forming the job may be collated at the same finisher, e.g., in the same tray.

It will be appreciated that the four sections 150, 152, 154, 156 can be stacked in any convenient order. In the illustrated embodiment, the merge module 20 is downstream of all the marking engines in the system 10, although it also contemplated that further marking engines or post-printing treatment processors may be coupled between the merge module 20 and one or both of the finishers 22, 24. While in the illustrated embodiment, the merge module 20 is shown as a separate module, it is also contemplated that the merge module may be incorporated into the media path of one of the finishers 22, 24 or elsewhere.

Figure 5:
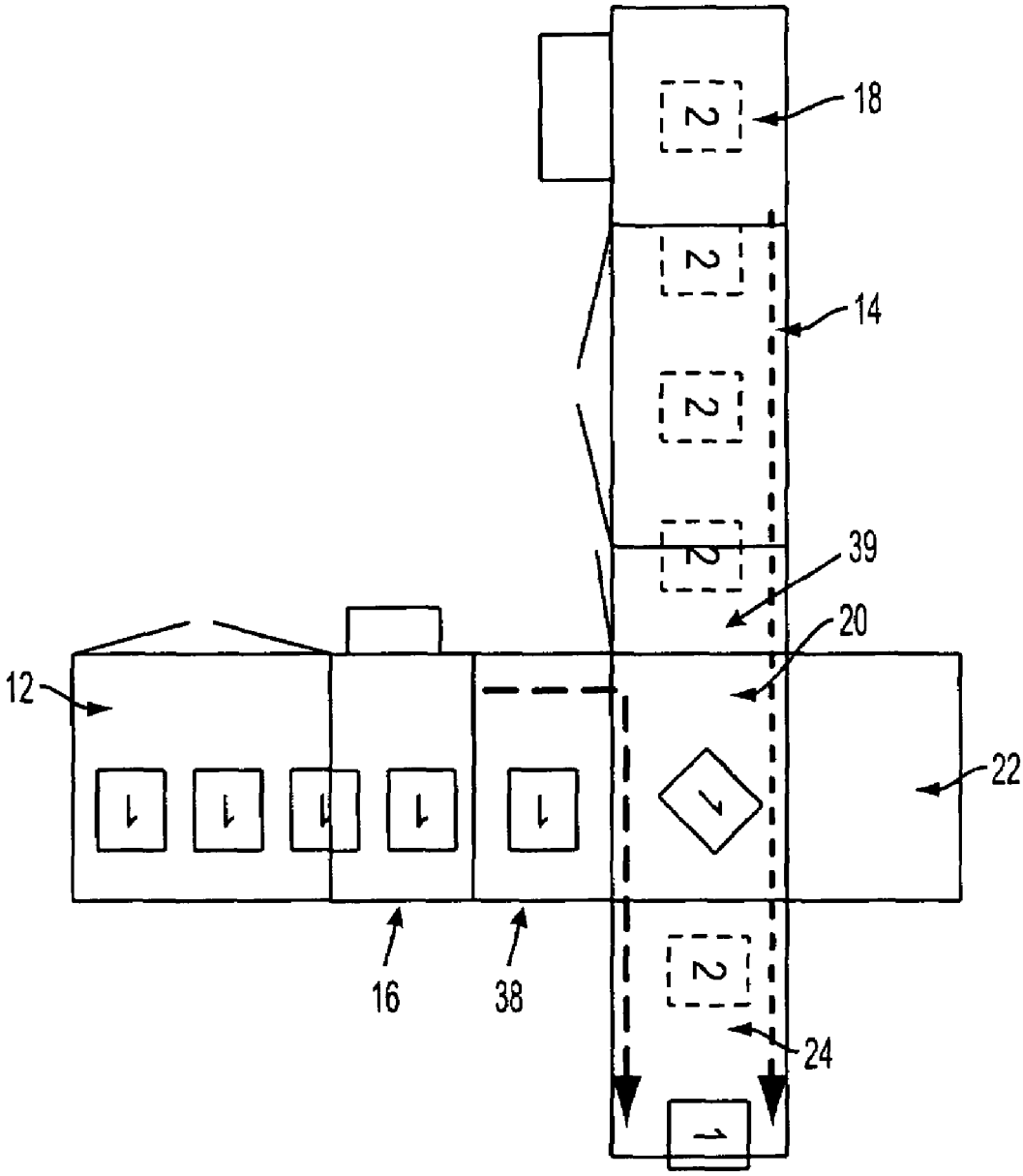
FIG. 5 illustrates merging of two paper streams in the merge module.

With reference to FIG. 5, an illustration of an exemplary merging of groups of sheets from a print job in which a first group of sheets from stream A is merged with a second group of sheets from stream B. Sheets 1 from marking engine 12 travel with the orientation indicated to merge module 20 while sheets 2 from marking engine 14 approach in the orthogonal direction. One of sheets 1 and 2 is rotated in merge module and merged with the other sheets to provide a merged stream, as shown.

Due to the rotation of one marking engine 1800, with respect to the downstream direction, as compared with an existing radial merge printing system configuration (e.g., as described in application Ser. Nos. 11/292,163 and 11/166,581), the images may be output in different orientations. Additionally, the sheets from marking engine 12 may be inverted, with respect to sheets from marking engine 14, due to an inversion in the overhead transport. To ensure the orientation of the resulting pages is correct on reaching the finisher 22, 24, an additional inversion step may be needed. If the printed page normally exits the marking engine 12 in face down orientation, in flipping the page 180° to enter the top transport 120, the page ends up in the face up orientation. This can be compensated for by inverting the printed page, e.g., in inverter 102, before exiting marking engine 12 thereby maintaining the correct face up/face down orientation. Alternatively, where the finishers 22, 24 are configured to accept the pages in a face down orientation, no inversion is required for the output of marking engine 12, since the inversion is essentially performed in the top transport 120. In this case, the output of marking engine 14 may be inverted by an inverter prior to merging with stream A.

FIG. 5 illustrates, by way of example, pages numbered 1 output from marking engine 12 being merged with pages numbered 2 output from marking engine 14. The pages 1 arrive at the merge module and are rotated 90° in an anticlockwise direction in the plane of the page so that they have the same orientation as pages 2. In this embodiment, pages 1 are alternated with pages 2 to provide a combined stream. In another embodiment, the image data sent to the marking engine 12 is rotated through 180° so that the output images are rotated 180°, relative to the downstream direction. In this case, the output may be rotated in the merge module in a clockwise direction in the plane of the paper. If the sheets are to be output to finisher 22 rather than finisher 24, an 180 image rotation in the plane for the sheets from marking engine 12 may prove the most efficient means of retaining sheet orientation integrity.

If 180° degree rotation in the image path for marking engine 12 is not performed, a more efficient process may be achieved where marking engine 14 serves as the primary printer (the one that the main print stream will be printed on) and marking engine 12 serves as the secondary printer (the one that inserts are printed on) for better paper handling reliability.

Since the paper path from marking engine 12 to the merge module 20 is longer than that from marking engine 14 to the merge module, a print job utilizing both marking engines may be scheduled such that marking engine 12 begins printing in advance of marking engine 14.

The exemplary embodiment enables a maximum print rate of the printing system 10 (e.g., expressed in prints per minute, ppm) to be close to the sum of the maximum outputs, in ppm, of the two marking engines 12, 14.

The efficient cross-stream configuration of FIG. 1 can be readily achieved by rotating one of the marking engines in an existing radial merge printing system configuration (e.g., as described in application Ser. Nos. 11/292,163 and 11/166,581) by 180° and providing a paper transport 120 across the top of that engine to bring the print stream into the merge module 20 to merge with the second print stream. The configuration of FIG. 1 has some or all of the following advantages over the prior systems: an improved operability of the printing system; an improved physical layout of a customer's shop floor space and workflow; an improvement in paper path reliability by elimination of inversion when delivering output to types of finishers requiring face-up input; efficient utilization of a customer's labor force; ease of conversion using the top transport; and reduced inventory costs through provision of the top transport as a consumer installable kit.

As will be appreciated, rather than using two left-to-right marking engines 12, 14, two right-to-left marking engines may be employed in a system which, in top plan view, is essentially a mirror image of that shown in FIG. 1.

Figure 6:
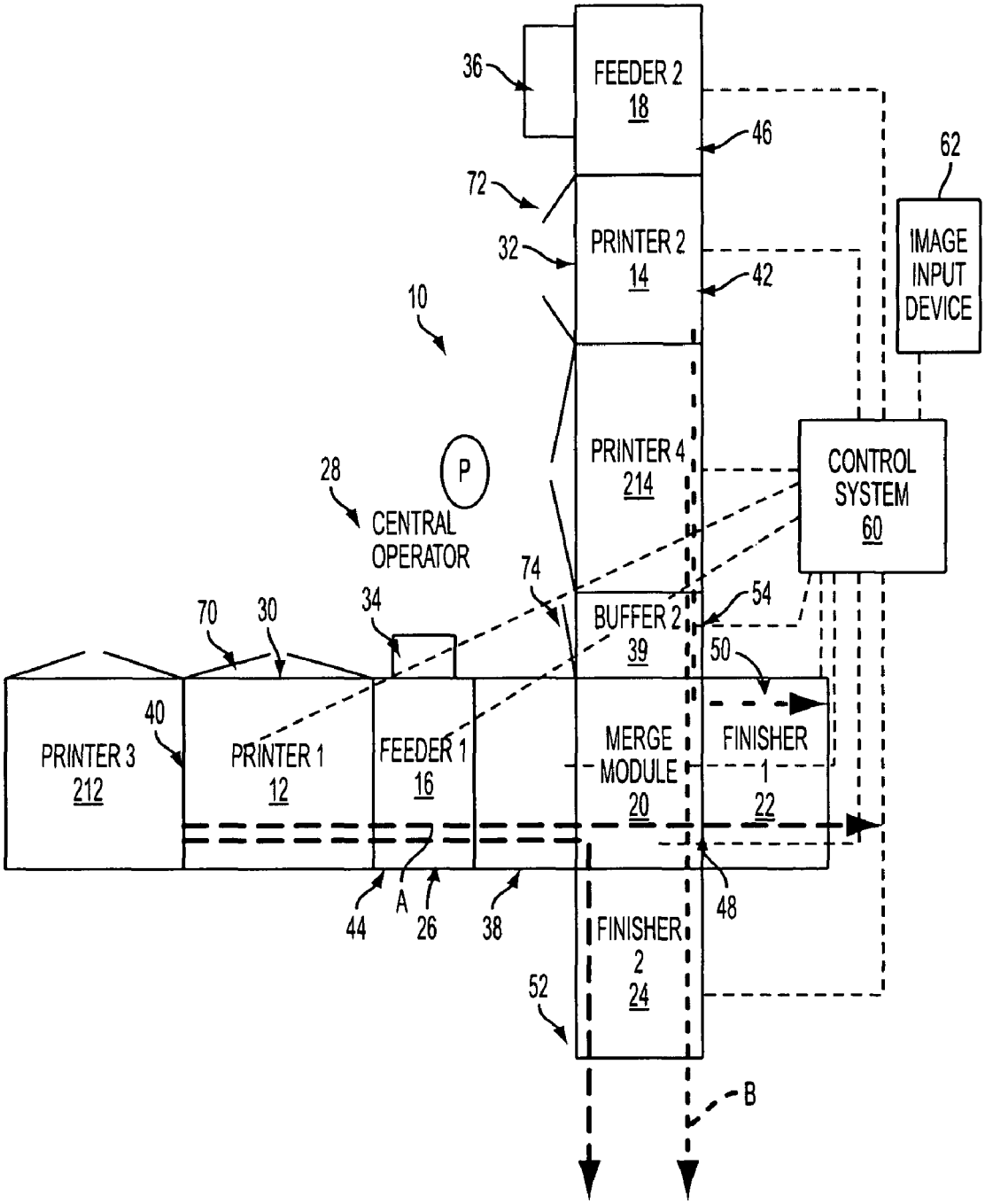
FIG. 6 is a top plan view of another embodiment of a printing system in accordance with the exemplary embodiment.

FIG. 6 shows a schematic view of another embodiment of a radial merge printing system 200, which may be similarly configured to printing system 10, except as otherwise noted. Similar elements are accorded the same numerals and new elements are accorded new numerals. In this embodiment, an additional marking engine 212 is connected to marking engine 12 to receive print media therefrom. Marking engine 212 thus receives, as its input, print media from marking engine 12, which may have been marked on one side by marking engine 12. Marking engine 212 may mark a second side of the page as in a tandem engine duplex system. An overhead transport (not shown) analogous to transport 120, conveys print media in the direction of arrow A over both marking engine modules 212, 12 and sheet feeder 16. The printing system of FIG. 1 may be readily expanded to incorporate one or both of additional marking engines 212, 214. In this embodiment, the overhead transport is extended to extend over marking engine 212 as well as marking engine 12. Marking engine 214 may serve as a tandem duplex engine for marking engine 14.

Figure 7:
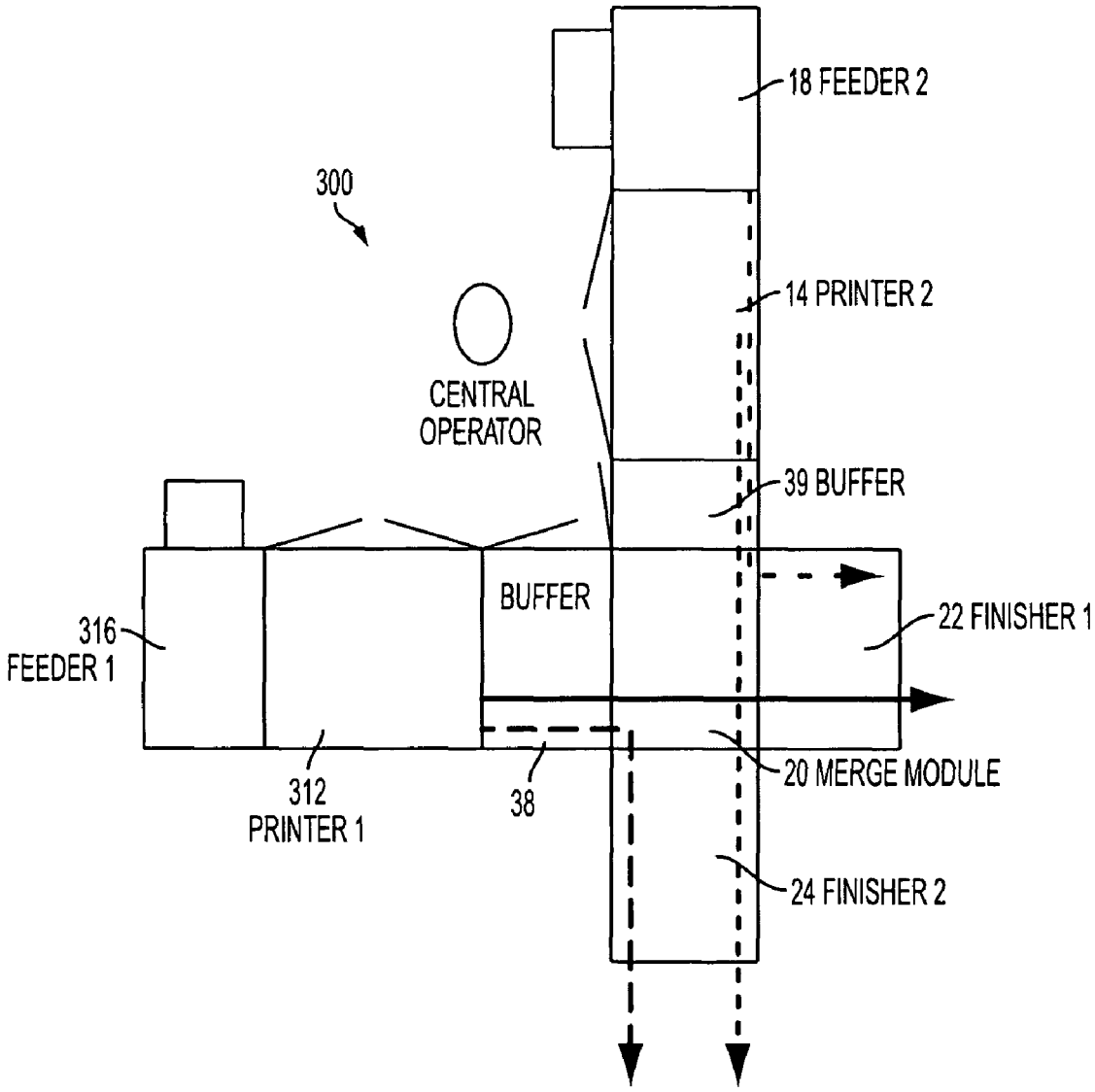
FIG. 7 is a top plan view of yet another embodiment of a printing system in accordance with the exemplary embodiment.

FIG. 7 shows a schematic view of another embodiment of a radial merge printing system 300, which may be similarly configured to printing system 10, except as otherwise noted. In this embodiment, a marking engine 312 may be a mirror image of marking engine 14, i.e., a right to left marking engine. This allows marking engine 312 to be physically located intermediate feeder 316 and the merge module 20. In FIG. 7, rather than utilizing two identically configured marking engines, such as two left-to-right or two right-to-left marking engines, two non-similar marking engines are employed where one left-to-right output marking engine and one right-to-left marking engine are combined. The overhead transport can therefore be omitted in this embodiment. The merge module 20 changes the direction and optionally rotates the sheets from stream A and/or B so that they can be merged into the other stream as described for the embodiment of FIGS. 1-5.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A printing system comprising:

a first marking engine which outputs marked print media to a first print stream, the first marking engine defining, at least in part, a first side of a working area;

a second marking engine which outputs marked print media to a second print stream which is angled to the first print stream, the second marking engine defining, at least in part, a second side of the working area whereby a user has access to the first and second marking engines via access members on the first and second sides of the working area;

a merge module which receives print media from the first and second print streams, the merge module including at least one rotate and redirect path for merging print media from one of the first and second streams with print media from the other of the first and second streams to generate a merged print stream;

a transport section which receives print media output by the first marking engine for transporting print media marked by the first marking engine in a direction opposite to a direction in which print media travels through the first marking engine, the transport section forming a part of a paper path which conveys print media marked by the first marking engine to the merge module without returning the print media to the first marking engine; and at least one finisher which receives the merged print stream from the merge module.

2. The printing system of claim 1, further comprising a first print media feeder which supplies print media to the first marking engine and a second print media feeder which supplies print media to the second marking engine.

3. The printing system of claim 2, wherein the first print media feeder is in the form of a first feeder module which is located intermediate the first marking engine and the merge module.

4. The printing system of claim 2, wherein the second print media feeder is in the form of a second feeder module and wherein the second marking engine is located intermediate the second feeder module and the merge module.

5. The printing system of claim 1, wherein the transport section comprises:

an overhead transport section which overlies the first marking engine.

6. The printing system of claim 1, wherein the transport section comprises a removable unit which is selectively removable from the first marking engine.

7. The printing system of claim 6, wherein the first and second marking engines are interchangeable, such that, when interchanged and the transport section is installed on the second marking engine, the user has access to the first and second marking engines via the access members on the first and second sides of the working area.

8. The printing system of claim 1, wherein the access members include doors which open into the working area.

9. The printing system of claim 1, wherein the access members are movable to provide access to at least one of the group consisting of marking engine components, paper trays, feeders, buffer components, customer replaceable units, jam clearance guides, and paper transports.

10. The printing system of claim 1, further comprising a multi-sheet buffer module intermediate one of the first and second marking engines and the merge module.

11. The printing system of claim 10, wherein the buffer module comprises a plurality of sheet buffers, each sheet buffer being long enough to contain the largest sheet length entirely and a plurality of buffer paths, wherein each buffer path has a controllable decision gate to direct the sheets and each sheet buffer has separate drive control of a plurality of nip rollers for each buffer path to control each sheet.

12. The printing system of claim 1, wherein the first and second marking engines are identically configured.

13. The printing system of claim 1, wherein the first marking engine is at a substantially 90 degree angle with respect to the second marking engine.

14. The printing system of claim 1, wherein the working area is substantially triangular.

15. The printing system of claim 1, wherein the first and second marking engines each comprise a xerographic marking engine.

16. The printing system of claim 1, further comprising a second finisher which receives print media from the merge module, the second finisher being substantially orthogonal to the first finisher.

17. A method of printing comprising:

using a printing system, the printing system comprising:

a first marking engine which outputs marked print media to a first print stream, the first marking engine defining, at least in part, a first side of a working area;

a second marking engine which outputs marked print media to a second print stream which is angled to the first print stream, the second marking engine defining, at least in part, a second side of the working area whereby a user has access to the first and second marking engines via access members on the first and second sides of the working area;

a merge module which receives print media from the first and second print streams, the merge module including at least one rotate and redirect path for merging print media from one of the first and second streams with print media from the other of the first and second streams to generate a merged print stream;

a transport section which receives print media output by the first marking engine for transporting print media marked by the first marking engine in a direction opposite to a direction in which print media travels through the first marking engine, the transport section forming a part of a paper path which conveys print media marked by the first marking engine to the merge module without returning the print media to the first marking engine; and at least one finisher which receives the merged print stream from the merge module;

outputting marked print media from the first marking engine to the first print stream;

transporting the first stream of marked print media to the merge module;

outputting marked print media from the second marking engine which outputs marked print media to a second print stream which is substantially orthogonal to the first print stream; and merging the first and second streams in the merge module to generate a merged print stream.

18. The method of claim 17, wherein the method further includes accessing the first and second marking engines from the working area.

19. A printing system comprising:

a first marking engine which outputs marked print media to a first print stream, the first marking engine defining, at least in part, a first side of a working area;

a second marking engine which outputs marked print media to a second print stream which is angled to the first print stream, the second marking engine defining, at least in part, a second side of the working area whereby a user has access to the first and second marking engines via access members on the first and second sides of the working area;

a merge module which receives print media from the first and second print streams, the merge module including at least one rotate and redirect path for merging print media from one of the first and second streams with print media from the other of the first and second streams to generate a merged print stream;

a transport section which receives print media output by the first marking engine for transporting print media marked by the first marking engine in a direction opposite to a direction in which print media travels through the first marking engine, the transport section defining a paper path which is generally parallel with a paper path which conveys print media through the marking engine, whereby print media, which has been marked on at least one side by the marking engine, is transported along the transport section paper path from an end of the marking engine which is furthest from the merge module to a position which is closer to the merge module than is an end of the marking engine which is closest to the merge module; and at least one finisher which receives the merged print stream from the merge module.

20. The printing system of claim 19, wherein the transport section comprises a removable unit which is selectively removable from the first marking engine.

21. The printing system of claim 19, wherein the first and second marking engines are identically configured.

22. The printing system of claim 19, further comprising a second finisher which receives print media from the merge module, the second finisher being substantially orthogonal to the first finisher.

* * * * *